US007984686B1

(12) United States Patent
Solorzano

(10) Patent No.: US 7,984,686 B1
(45) Date of Patent: Jul. 26, 2011

(54) CANOPY FOR KAYAK AND CANOE

(75) Inventor: Patricio X. Solorzano, Miami, FL (US)

(73) Assignees: Patricio X. Solorzano, Miami, FL (US); Barbara Valdes Crown, Miami, FL (US); Major Curtis Fussell, Palm Beach Gardens, FL (US)

( * ) Notice: Subject to any disclaimer, the term of this patent is extended or adjusted under 35 U.S.C. 154(b) by 103 days.

(21) Appl. No.: 12/466,013

(22) Filed: May 14, 2009

Related U.S. Application Data

(60) Provisional application No. 61/053,223, filed on May 14, 2008.

(51) Int. Cl.
*B63B 17/02* (2006.01)

(52) U.S. Cl. ..... 114/361

(58) Field of Classification Search ..... 114/361
See application file for complete search history.

(56) References Cited

U.S. PATENT DOCUMENTS 5,092,262 A * 3/1992 Lacy ..... 114/361
5,697,320 A * 12/1997 Murray ..... 114/361

* cited by examiner

*Primary Examiner* — Stephen Avila
(74) *Attorney, Agent, or Firm* — Gold & Rizvi, P.A.; H. John Rizvi; Glenn E. Gold

(57) ABSTRACT

A canopy for a small watercraft, such as kayak or canoe. The canopy has a generally rectangular planar frame supported overhead of an individual occupant of the watercraft by a forward leg assembly and an aft leg assembly. The frame is provided with a cover designed for protecting the individual from direct sunlight. The forward leg assembly is releasably connected to brackets mounted on the watercraft and the aft leg assembly is pivotally connected to brackets mounted on the watercraft so that the forward leg assembly may be released from the brackets and the aft leg assembly may pivot about an axis perpendicular to the centerline of the watercraft to support the frame in an upright orientation to catch wind as a downwind sail.

10 Claims, 9 Drawing Sheets

CANOPY FOR KAYAK AND CANOE

CROSS-REFERENCE TO RELATED APPLICATION

This application claims the benefit of U.S. Provisional Patent Application Ser. No. 61/053,223, filed on May 14, 2008, which is incorporated herein in its entirety.

BACKGROUND OF THE INVENTION

1. Field of the Invention

The present invention relates generally to sun shades for watercraft and particularly to a rigid frame canopy for small watercraft.

2. Description of the Prior Art

The sport of pleasure boating is very popular in the summer season, when the weather tends to be uncomfortably warm. On relatively large vessels, awnings are frequently used to shade the deck, from direct sunlight, for the comfort of the occupants. Sailing vessels are equipped with booms and spars, any of which conveniently serve as a ridge pole for rigging an awning. Large power boats have stanchions or deck railings, which may conveniently support uprights for supporting an awning.

On smaller human powered watercraft, hardware for rigging an awning is generally not available. In hot weather, the exertion involved in rowing or paddling a boat, increases the need for protecting occupants from direct sunlight. Small watercraft is frequently used for fishing in shallow waters. An individual fishing from a small watercraft may spend several hours in direct sunlight, on a hot day. The combination of rowing or paddling together with long time periods spent in the sun, may contribute to heat exhaustion and attendant dangers associated with such a condition. The danger from heat exhaustion is more pronounced in water sports because an individual, who is boating some distance from shore, may have difficulty reaching a place to rest, cool down, and drink fluids.

Protection from direct sunlight may be provided, for individuals in small watercraft, by a device similar to an umbrella. The umbrella-like device includes a fabric cover attached to a collapsible frame of semi-rigid members. The semi-rigid nature of the frame limits the size of the device to a generally rounded cover having a size comparable to a conventional umbrella. There is a need for a rigid frame canopy, for use on small watercraft, having a size and shape suitable for protecting the head, upper torso, and outstretched legs, of an individual seated in the watercraft.

SUMMARY OF THE INVENTION

The present invention is directed to a canopy for a small watercraft designed to protect an individual occupying the watercraft from direct sunlight and to conveniently pivot to an upright orientation for catching wind as a downwind sail. The canopy includes a generally planar rigid frame, a rigid forward leg assembly, a rigid aft leg assembly, a cover, and a plurality of brackets. The frame is horizontally oriented overhead of the individual and includes a perimeter member. The forward leg assembly is attached by attaching means to the perimeter member, projects downward from the perimeter member, and includes forward lower extremities having first connecting means designed to connect to one or more of the brackets mounted on the watercraft. The first connecting means may be designed for releasable connection. The aft leg assembly projects downward from the perimeter member and includes aft lower extremities having second connecting means designed to connect to others of the brackets mounted on the watercraft and located aft of the forward leg assembly. The second connecting means may be designed for pivotal connection.

The forward leg assembly and the aft leg assembly support the frame overhead of the individual. The cover is formed of flexible material designed to impede passage of sunlight and the cover is overlayed on the frame and secured, by securing means to the perimeter member. The frame and cover are preferably of a size and shape to provide shade for the individual seated in the watercraft, with outstretched legs.

The forward leg assembly may be detached and the frame may pivot about the second connecting means to position the frame in a supported upright position to catch a wind and to act as a downwind sail, for the watercraft.

It is an object of the present invention to provide a canopy for a small watercraft, the canopy having a planar rigid frame with a perimeter member suitable for securing a cover to shade an individual occupying the watercraft.

It is an object of the present invention to provide a canopy for a small watercraft, the canopy having a planar rigid frame supported by a forward leg assembly and an aft leg assembly.

It is an object of the present invention to provide a canopy for a small watercraft, the canopy having a planar rigid frame and cover secured on the frame, and being sized to provide shade for an individual seated in the watercraft with outstretched legs.

It is an object of the present invention to provide a canopy for a small watercraft, the canopy having the capacity to pivot to function as a downwind sail.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Figure 1:
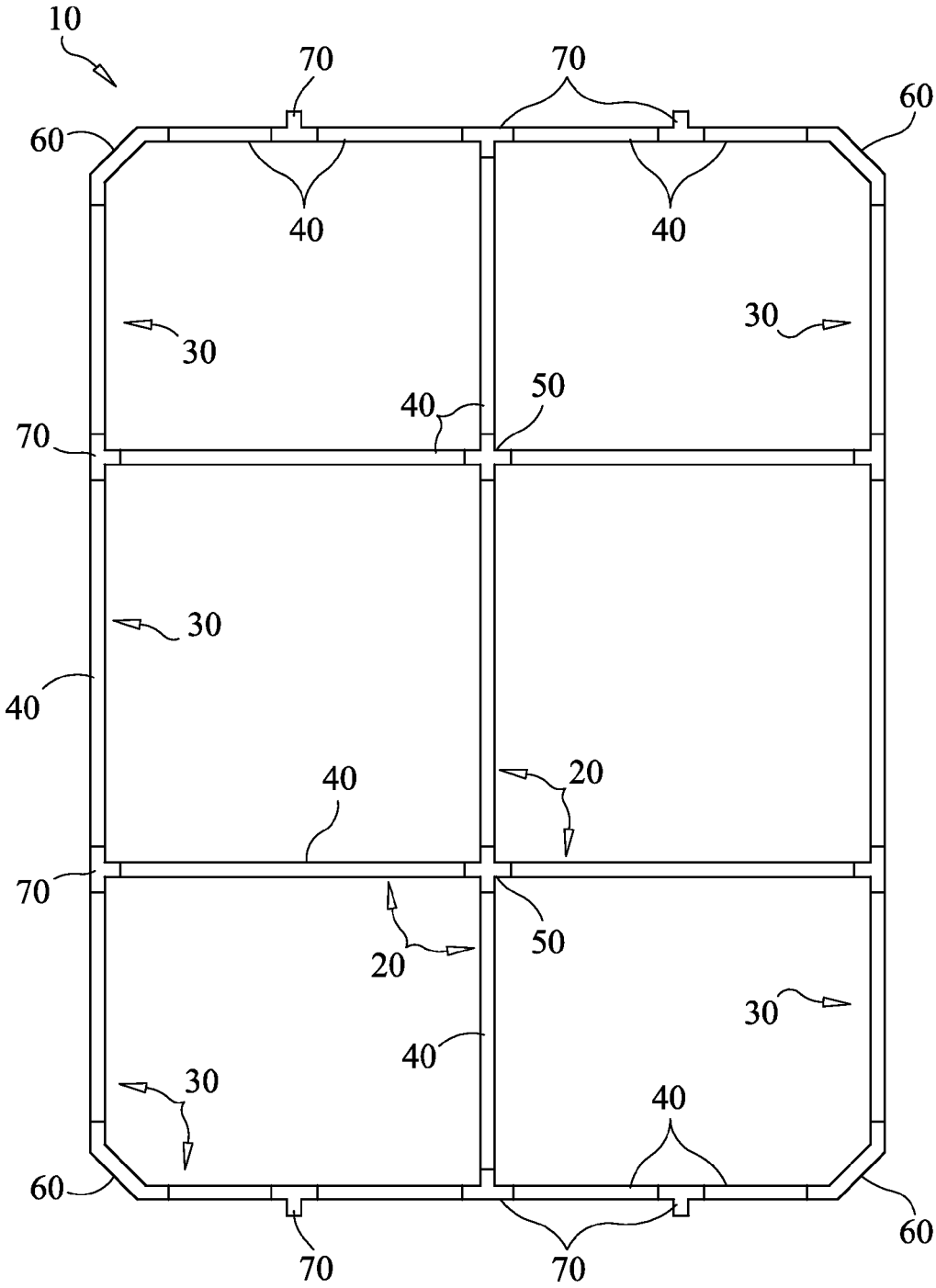
FIG. 1 is a plan view of the frame of the present invention.

As shown throughout the drawings, the present invention is directed toward a canopy for a small watercraft designed to provide shade from direct sunlight, for a seated individual occupant, and to pivot to an upright orientation for catching wind as a downwind sail. The canopy includes a rigid planar frame 10 as shown in FIG. 1, preferably formed of lightweight tubular components of metal, such as aluminum, or of plastic, such as poly vinyl chloride (PVC). The frame 10 is of generally rectangular shape and includes cross-members 20 and a perimeter member 30. A frame, for the canopy of the present invention may be formed with a unitary or modular construction but, for storage and transport, it is preferred that the frame 10 be formed of a plurality of segments joined by coupling units. As shown in FIG. 1, the cross-members 20 are formed of seven tubular segments 40 joined together by two four-way coupling units 50. The four-way coupling units 50 are preferably PVC joints, each having four receptacles, sized to receive an end portion of one of the tubular segments 40 in snug fitting frictional engagement, for retaining the tubular segments 40 in interconnected relation for forming the cross-members 20. The perimeter member 30 is formed of four corner units 60, a plurality of tubular segments 40, which may be of varying lengths, and a plurality of three-way coupling units 70. The three-way coupling units 70 and corner units 60 are preferably formed of the same material used for forming the four-way coupling units 50, with each of the three-way coupling units 70 having three receptacles, each of the corner units 60 having two receptacles, and designed in a like manner to join the tubular segments 40 of the perimeter member 30 and to join the perimeter member 30 to the cross-members 20. As shown in FIG. 1, four of the three-way coupling units 70 forming a portion of the perimeter member 30 have an empty receptacle, the purpose of which will be explained below.

Figure 2:
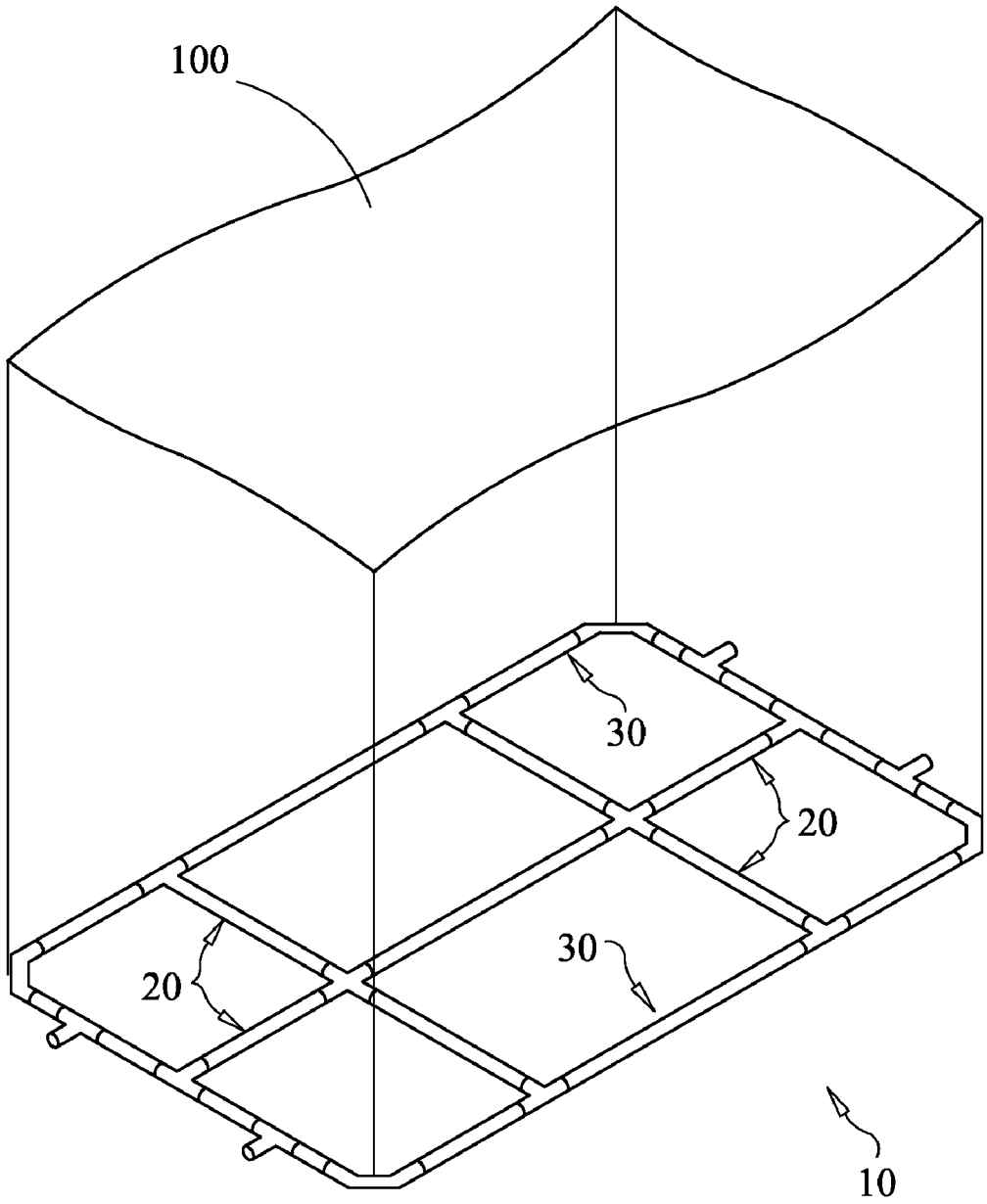
FIG. 2 is an exploded perspective view of a frame and cover of the present invention.

As shown in FIG. 2, a cover 100, having a generally rectangular shape and being sized to correspond to the size and shape of the frame 10 is provided. The cover 100 is preferably formed of flexible material such as nylon or plastic fabric. The cover is to be secured to the perimeter member 30 by partially wrapping a portion of the cover 100 onto the perimeter member 30 and securing the cover 100 by securing means, such as sewing, gluing, stapling or other conventional means.

Figure 3:
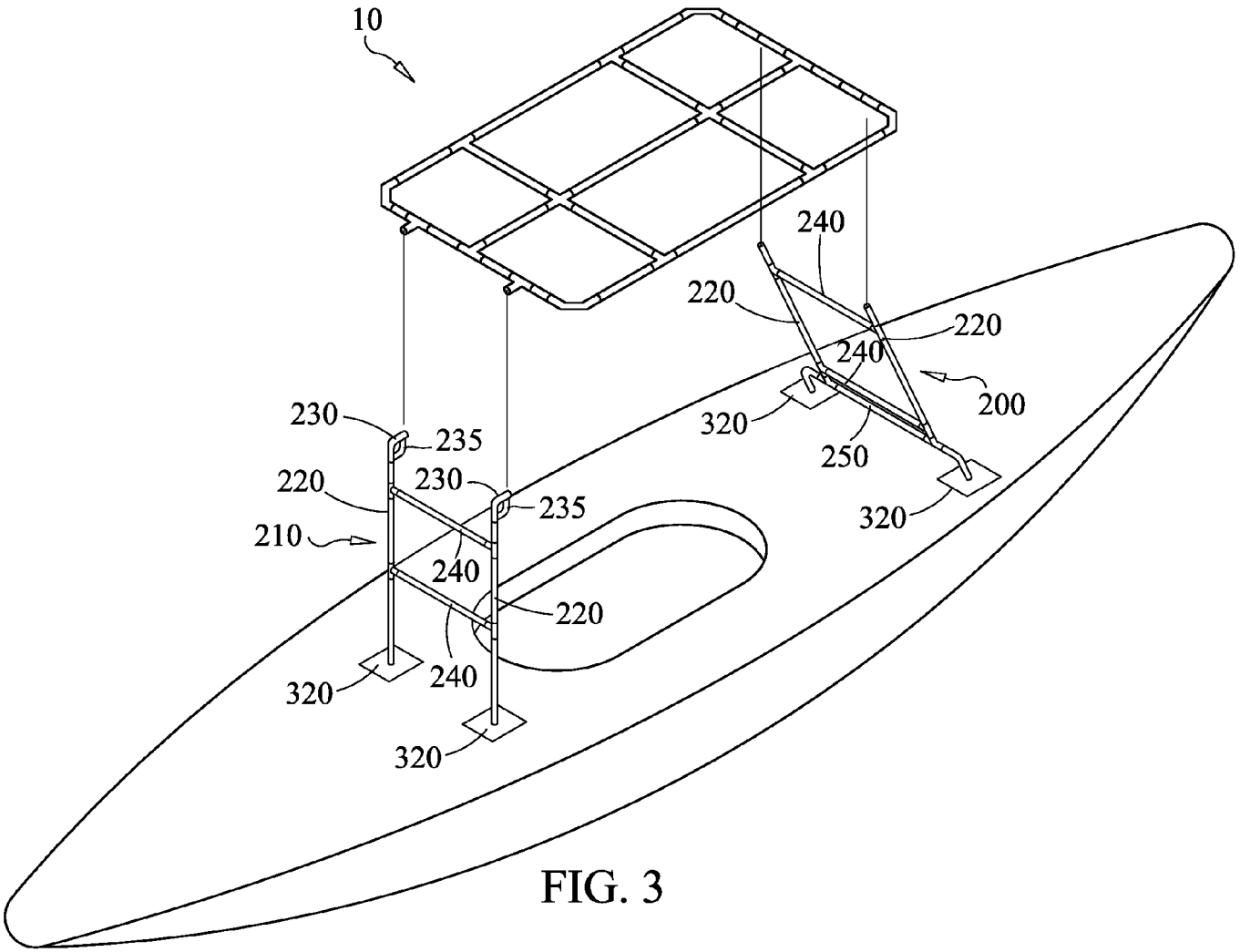
FIG. 3 is a perspective view of a kayak with a frame, forward leg assembly, and aft leg assembly, the frame being separated for convenient viewing.

As shown in FIG. 3, a rigid forward leg assembly 200 and a rigid aft leg assembly 210 are provided for supporting the frame 10 and cover 100 in generally horizontal orientation overhead of the individual occupant of a watercraft such as a kayak 300. The forward leg assembly 200 projects downward from the perimeter member 30 and is preferably formed of tubular PVC uprights 220. At an upper portion of the forward leg assembly, each of the uprights 220 is designed to be received in snug fitting frictional engagement to mate with two receptacles of the three-way coupling units 70 of the frame 10, such that the forward leg assembly 200 may be retained and project downward. It will be appreciated that other conventional means of forming a junction between the frame 10 and the forward leg assembly 200, including a unitary construction, may be employed. It is preferred that the forward leg assembly have one or more cross bars 240 extending between the uprights 220, which may also be formed of a rigid plastic such as PVC. It is preferred that the cross bars 240 be spaced apart vertically to allow maximum forward visibility. A lower portion of the forward leg assembly 200 is provided with two forward lower extremities having first connecting means for connecting the forward leg assembly 200 to the watercraft. As shown in FIG. 3, the lower portion of the forward leg assembly 200 may include a bridge section 250 designed to position the forward lower extremities outboard of the uprights 220, straddling the centerline of the watercraft, to increase the stability of the canopy. It may also be advantageous to include a bridge section 250, as shown in FIG. 3, to align each of the first connecting means with a standard fitting provided on a stock watercraft, for retrofitting the canopy of the present invention to a conventional watercraft. The first connecting means may be adapted to connect to the standard fittings. It will be appreciated that the forward leg assembly 200 may be alternatively configured with the forward lower extremities and the first connecting means provided on a lower portion of the uprights 220, thus eliminating the bridge section 250. It will also be appreciated that the downwardly extending forward leg assembly 200 need not have a vertical orientation and it may be advantageous to place the forward lower extremities forward of the leading edge of the frame 10 to provide additional space for maneuvering a paddle. Although the illustrations present a pair forward lower extremities and a pair aft lower extremities, it is recognized that a minimum of only three supporting lower extremities are required to support the frame 10.

The aft leg assembly 210 includes uprights 220 each having an upper portion with an elbow 230, having a ninety degree turn and being configured to mate with a three-way coupling unit 70, on the frame 10, such that the aft leg assembly 210 projects perpendicularly downward from the perimeter member 30. Each elbow 230 preferably includes a strut 235 spanning the ninety degree angle, for increasing the rigidity of the junction between the aft leg assembly 210 and the frame 10. The aft leg assembly 210 is likewise formed of PVC and is connected to the perimeter member 30 opposite the front leg assembly 200 and also straddling the centerline of the watercraft. The aft leg assembly 210 is shown in FIG. 3 with a lower portion having aft lower extremities and second connecting means provided on a lower portion of the uprights 220 and no bridge section. As with the forward leg assembly 200, the aft leg assembly 210 may be formed with or without a bridge section. The forward leg assembly 200 and the aft leg assembly 210, including the bridge section 250 may be assembled with three way coupling units 70 and may be advantageously glued to improve the structural integrity of the support for the canopy.

Figure 4A:
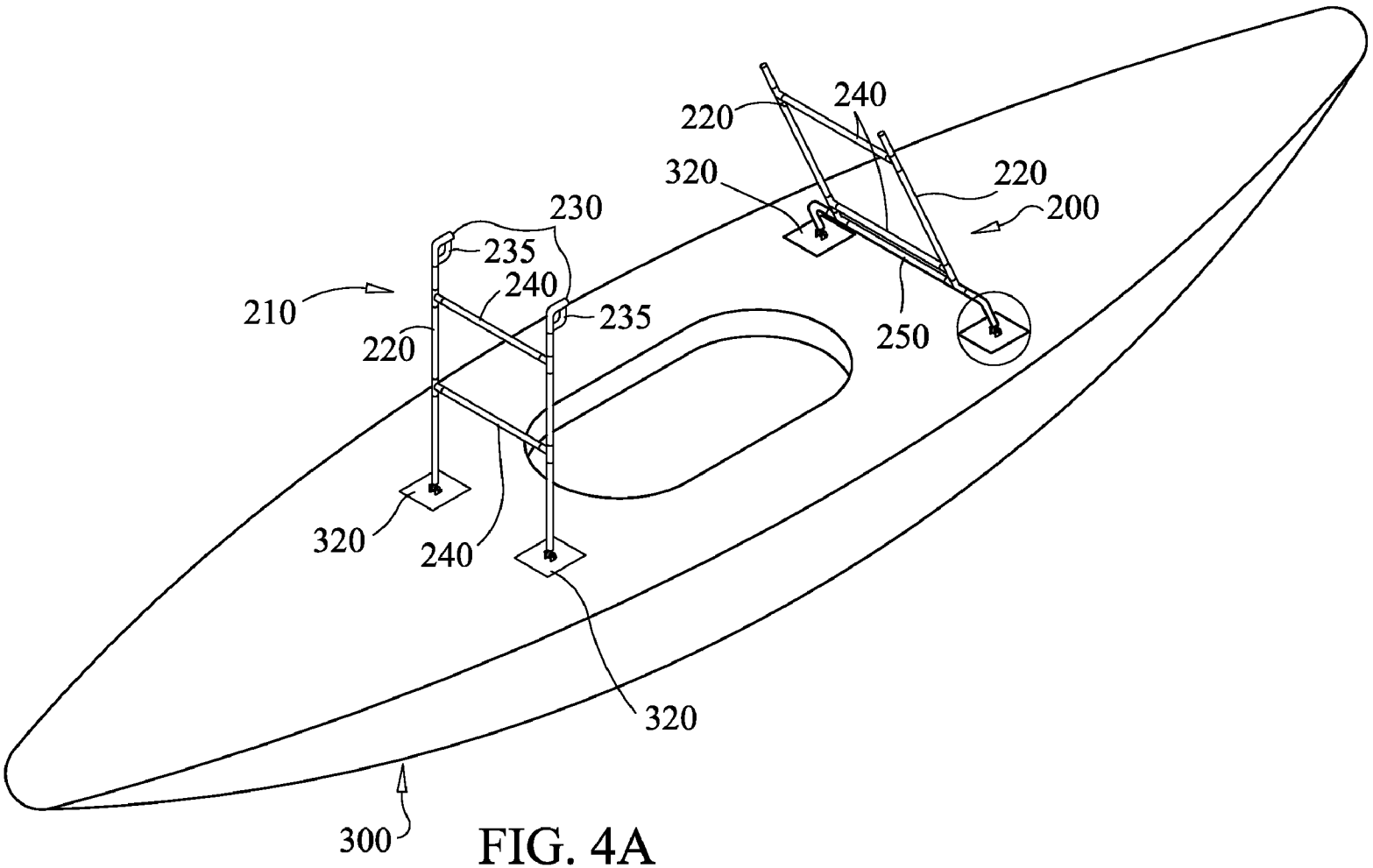
FIG. 4A is a perspective view of a kayak with a forward leg assembly and aft leg assembly.
Figure 4D:
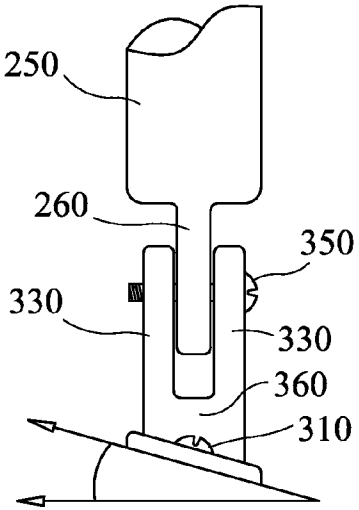
FIG. 4D is an elevation view of a bracket and connecting means.
Figure 4C:
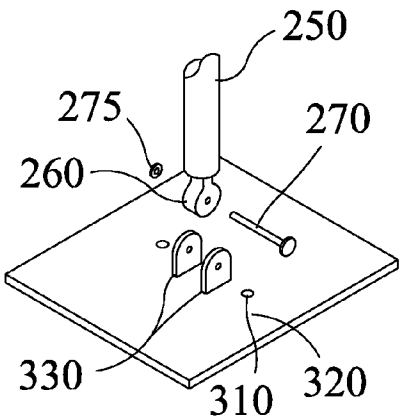
FIG. 4C is an exploded perspective view of the bracket and connecting means.
Figure 4B:
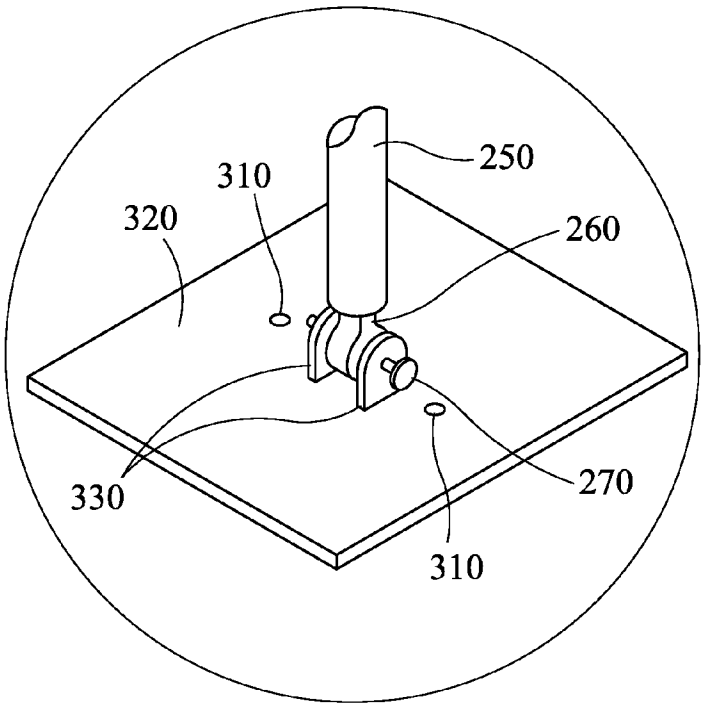
FIG. 4B is an inset of a portion of FIG. 4A showing detail of a bracket and connecting means.

As an alternative to retrofitting the canopy to standard fittings, brackets are provided on the watercraft for attaching the first connecting means and second connecting means, to secure the canopy to the watercraft. Brackets may preferably be mounted conventionally by fasteners such as bolts 310. In a first embodiment, each of the brackets includes a plate 320 having a pair of aligned upstanding spaced apart tabs 330, as shown in FIG. 4A and detailed in the FIG. 4B inset. It is to be understood that each of the brackets is to be configured as shown in FIG. 4B. The first connecting means may comprise a tongue 260 on each of the forward lower extremities of the forward leg assembly 200 and on each of the aft lower extremities of the aft leg assembly 210, as shown in FIG. 4C. The tongue 260 is preferably sized to pass between the tabs 330, and provided with an aperture to receive a pin 270 disposed in a pair of aligned holes provided in the tabs 330 and passing through the aperture. The pin 270 is preferably provided with a head at one end and a transverse opening at the opposite end, for receiving a metal ring 275, to retain the pin 270 and secure the tongue 260 on the bracket. It will be appreciated that other conventional connecting means may serve with alternative brackets adapted to connect the forward leg assembly 200 and the aft leg assembly 210 to the brackets on the watercraft. For example, a roundhead bolt 350 may be passed through the tongue 260 and each of the holes in the tabs 330, to secure the leg assemblies on the brackets, as shown in FIG. 4D.

Figures 5A, 5B:
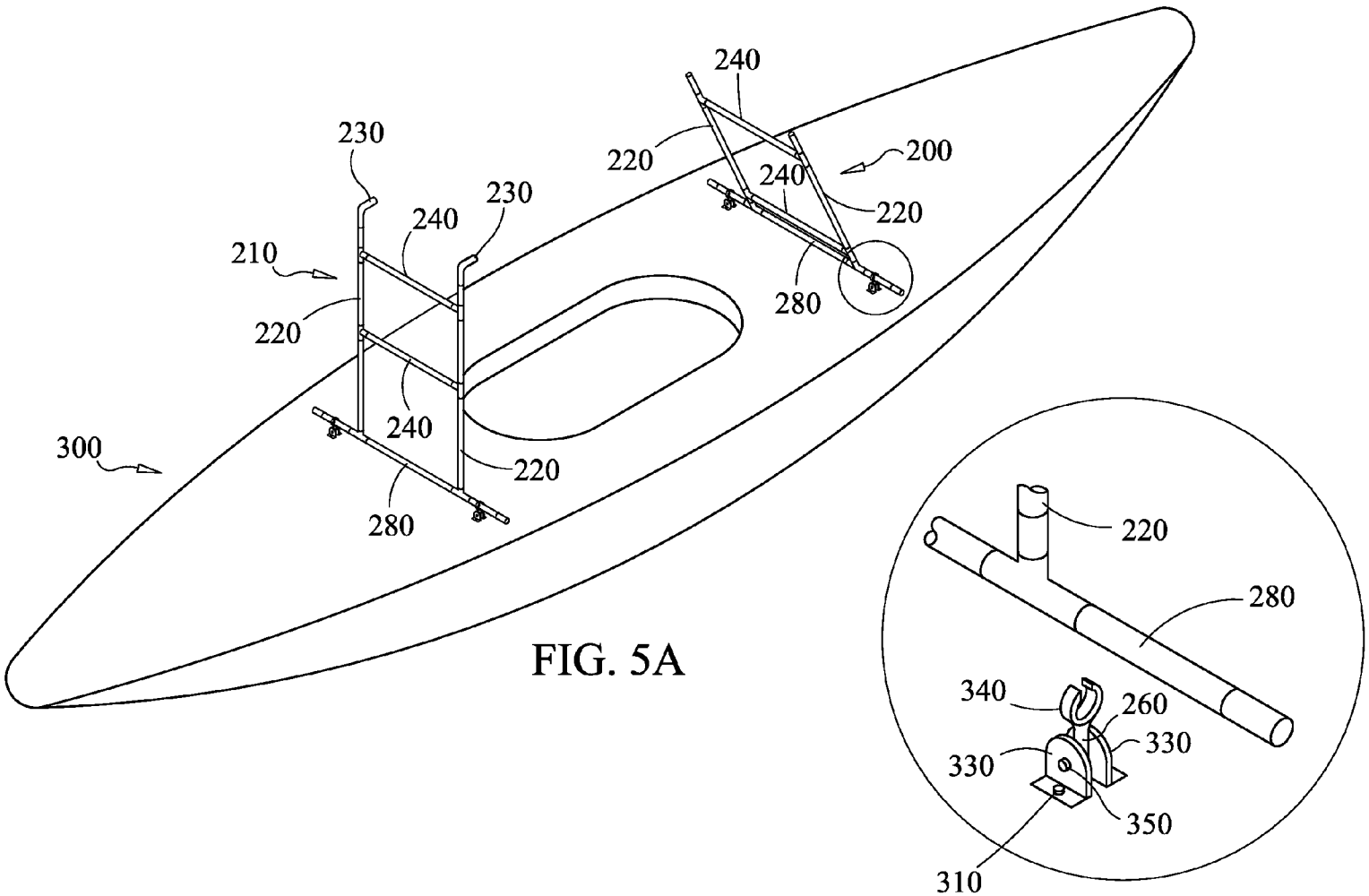
FIG. 5A is a perspective view of a kayak with a forward leg assembly and aft leg assembly.
FIG. 5B is an inset of a portion of FIG. 5A showing detail of a bracket and alternate connecting means.

FIG. 5A shows a second embodiment of the present invention wherein the connecting means comprises two transverse rods 280 and a plurality of "U" shaped clips 340. The lower extremities of the forward leg assembly 200 are joined to one of the transverse rods 280. The aft lower extremities of the aft leg assembly 210 are each joined to the other of the transverse rods 280. The transverse rods 280 are connected to the uprights 220 by an additional pair of three-way coupling units 70 and configured to be received and retained by a pair of the "U" shaped clips 340, adapted for mounting on brackets, shown in detail in the FIG. 5B inset. Each of the clips 340 is provided with a tongue 260 to be connected to the brackets as described above. Each of the brackets is mounted on the kayak 300, in a location selected to conveniently receive a portion of one of the transverse rods 280. The transverse rods 280 add lateral support to the canopy.

Small watercraft, particularly kayaks, frequently have a sloping deck. It is preferred that the brackets of the present invention be configured to accommodate the curvature of the deck. In the first embodiment of the present invention, the brackets may include a wedge portion 360 disposed between the plate 320 and the tabs 330, as shown in FIG. 4D. The wedge portion 360 supports the tabs 330 in vertical orientation when the plate 320 is canted at an angle indicated by a pair of arrows crossed by an arc, in FIG. 4D. It is to be understood that the plate 320, in FIG. 4D, is oriented such that the arrows are perpendicular to the centerline of the watercraft.

Figure 5C:
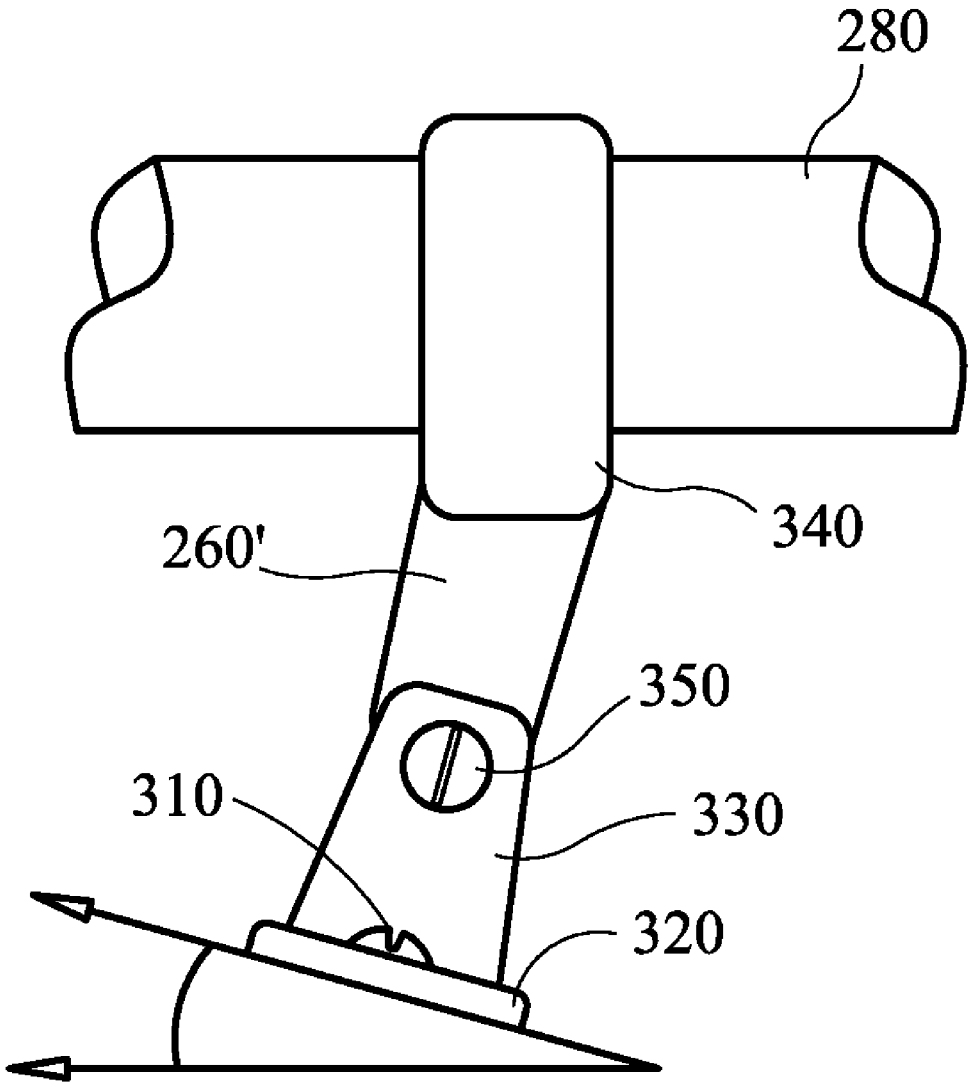
FIG. 5C is an elevation view of a bracket and second alternate connecting means.

FIG. 5C illustrates a bracket and connecting means of the second embodiment of the present invention. The plate 320 is mounted on the deck of the watercraft, canted at an angle indicated by arrows, as in FIG. 4D. Likewise, the arrows are perpendicular to the centerline of the watercraft. The connecting means include "U" shaped clips 340 and a slanted tongue 260' projecting at an angle selected to place the "U" shaped clips 340 in vertical orientation. The slanted tongue 260 may be formed with greater length as necessary to retain the transverse rods 280 at a height corresponding to the highest point of the curved deck of the watercraft.

In use, the frame 10 with attached cover 100, is supported by the forward leg assembly 200 and aft leg assembly 210 overhead of an individual occupying the watercraft. The present invention is depicted on a kayak 300 in FIG. 6. It will be appreciated that the present invention may be installed on a canoe or other small watercraft, using appropriately adapted and positioned brackets.

Figure 7:
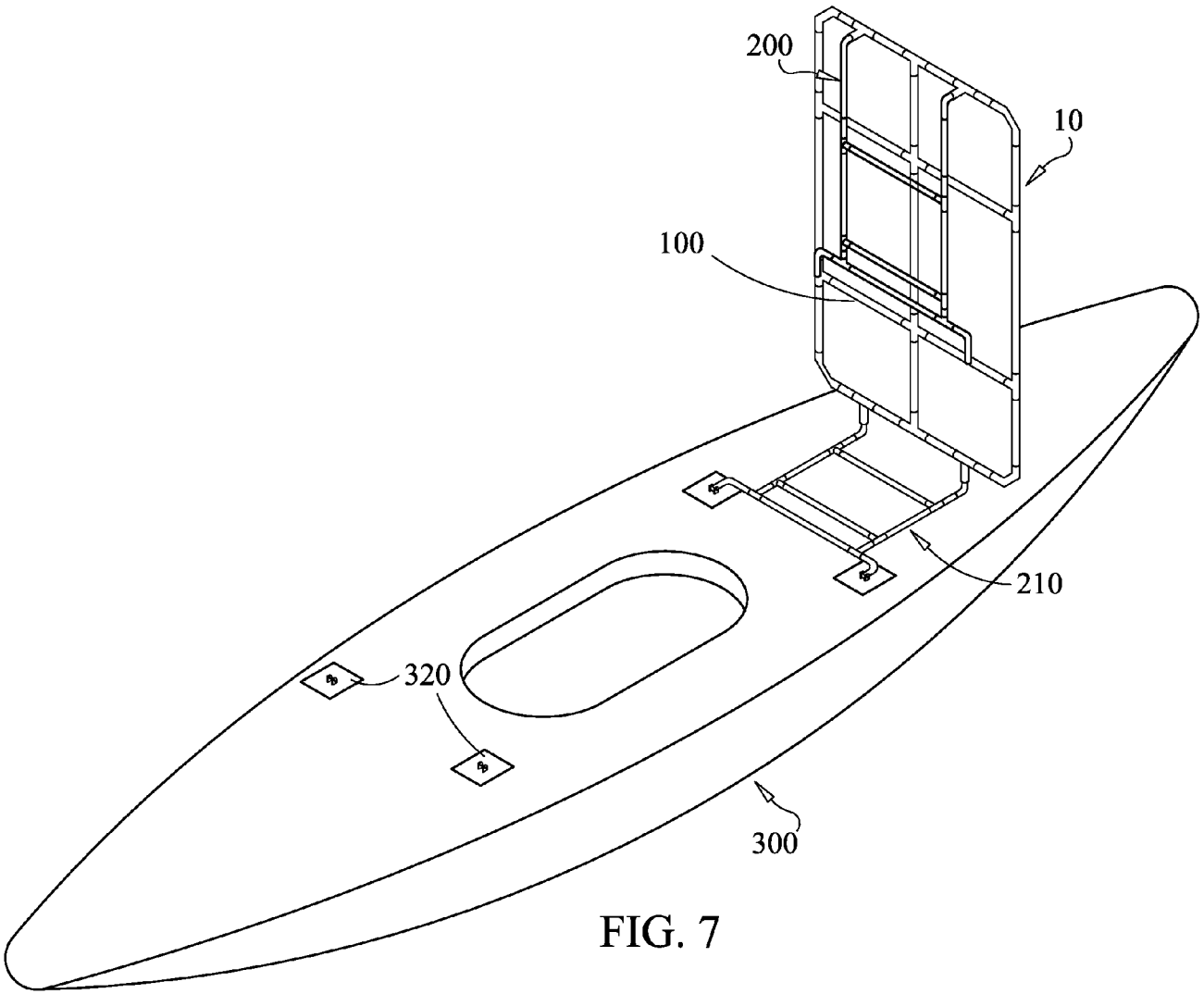
FIG. 7 is a perspective view of a kayak with the canopy of the present invention pivoted to the position intended for acting as a downwind sail.

It is preferred that the first connecting means and a first number of brackets be configured to releasably retain the forward leg assembly 200 and that the second connecting means and a second number of brackets be configured to pivotally retain the aft leg assembly 210, such that the forward leg assembly 200 may be released and the aft leg assembly 210 may pivot about an axis perpendicular to the centerline of the watercraft, to support the frame 10, with attached cover 100 in upright position for catching wind as a downwind sail, as shown in FIG. 7. The forward leg assembly 200 may be released from the brackets and remain attached to the perimeter member 30. The three-way coupling units 70, which connect the forward leg assembly 200 to the perimeter member 30 may be adapted to rotate so that the forward leg assembly 200 may hang adjacent to the frame 10. It will be appreciated that, in the first embodiment, the forward leg assembly 200 may be released by removing the pin 270 from each of the forward lower extremities and that the aft leg assembly 210 may pivot about the pin 270 in each aft lower extremity of the aft leg assembly 210. In the second embodiment, the one of the transverse rods 280 at the lower extremity of the forward leg assembly 200 may be drawn upward to disengage the clips 340 and the other of the transverse rods 280 at the lower extremity of the aft leg assembly 210 may pivot by rotating within the clips 340. In the first embodiment and in the second embodiment, it is preferred that the brackets supporting the aft leg assembly 210 be mounted in an orientation so as to allow the aft leg assembly 210 to pivot about an axis perpendicular to the centerline of the watercraft.

Alternatively, the forward leg assembly 200 may be configured to release from the perimeter member 30 and remain connected to the watercraft while the frame and aft leg assembly 210 pivot as described above. Conventional connectors and fasteners may be used to accomplish these alternative embodiments.

Figure 6:
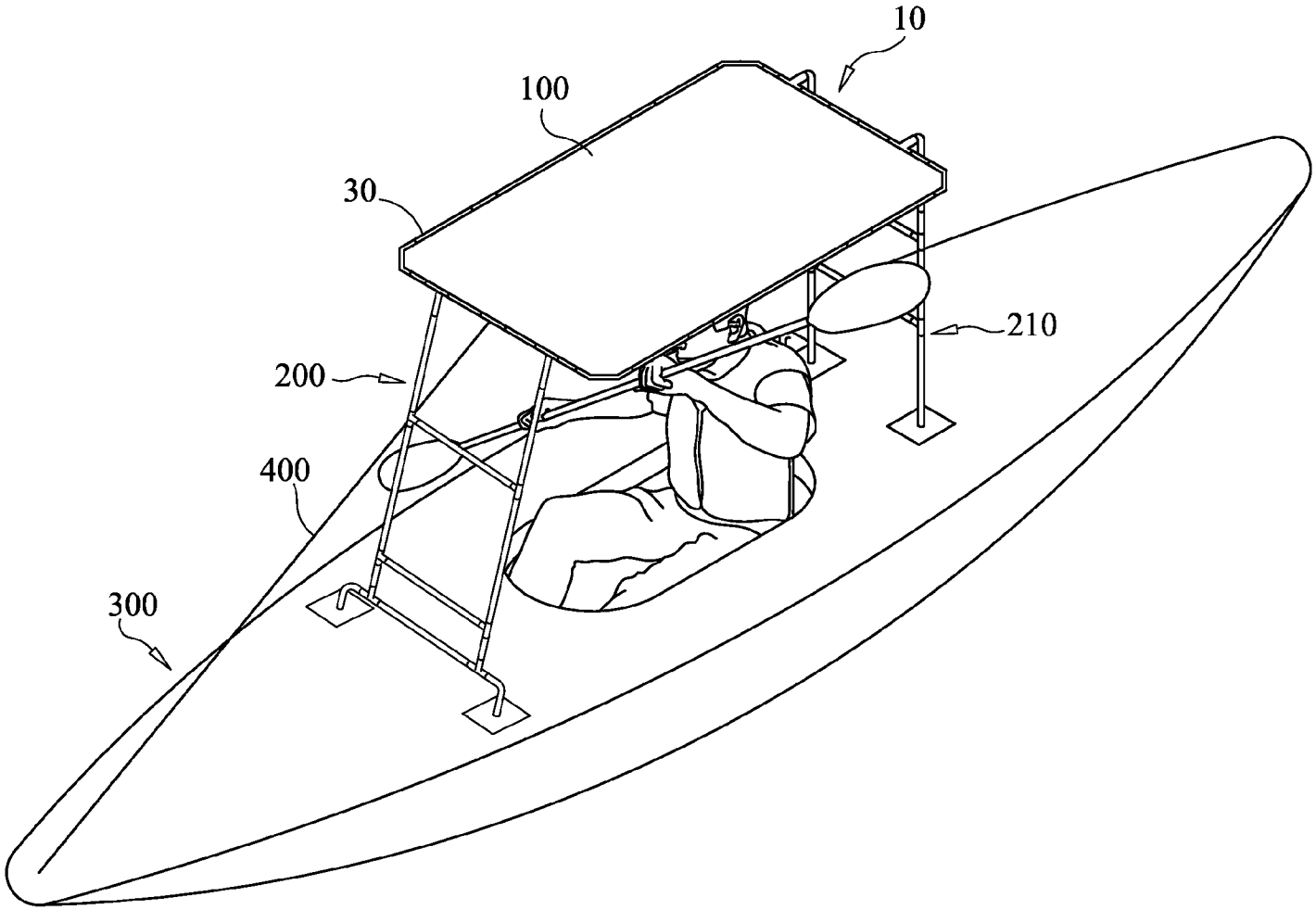
FIG. 6 is a perspective view of a kayak with a seated individual and the canopy of the present invention.

The canopy of the present invention, as shown in FIG. 6, has a generally rectangular shape for providing shade for the head, upper torso, and outstretched legs of an individual occupying the kayak 300. The forward leg assembly 200 and aft leg assembly 210 are positioned so as to allow unrestricted movement of paddles or oars, while in use. The present invention may be used to equal advantage on a canoe or other small watercraft. A foreguy 400, as shown in FIG. 6, formed of flaccid material, such as line, may be extended from a leading edge of the perimeter member 30 to a fitting at a point proximate to the bow of the watercraft to increase stability of the canopy. A battery-operated light (not shown) may be mounted on the perimeter member 30 to call attention to the presence of the watercraft. While the preferred embodiments of the invention have been described above, it will be recognized and understood that various modifications can be made in the invention and the appended claims are intended to cover all such modifications which may fall within the spirit and scope of the invention.

What is claimed is:

1. On a watercraft to be occupied by an individual, a canopy comprising:

a generally planar rigid frame, a rigid forward leg assembly, a rigid aft leg assembly, a cover, and a plurality of brackets;

said frame including a perimeter member;

said frame being generally horizontally oriented, overhead of said individual;

said forward leg assembly being attached, by attaching means, to said perimeter member and projecting downward from said perimeter member;

said forward leg assembly having at least one forward lower extremity;

each of said at least one forward lower extremity having first connecting means;

a first number of said brackets corresponding to the number of said at least one forward lower extremity being mounted on said watercraft and connected to said first connecting means;

said first connecting means being releasable;

said aft leg assembly projecting perpendicularly downward from said perimeter member and having at least one aft lower extremity;

each of said at least one aft lower extremity having second connecting means;

a second number of said brackets corresponding to the number of said at least one aft lower extremity being mounted on said water craft, aft of said first number of brackets and being connected to said second connecting means;

said second connecting means being designed for pivoting about an axis generally perpendicular to the centerline of said watercraft;

said cover being formed of material designed to impede the passage of sunlight and being attached to said frame, for protecting said individual from direct sunlight;

said attaching means being designed for pivoting about an axis generally perpendicular to the centerline of said watercraft;

whereby said forward leg assembly may be released from said watercraft, said frame may pivot aft about said second connecting means, said forward leg assembly may pivot to a position generally parallel to said frame, and said cover may act as a sail.

2. The canopy of claim 1 wherein:

said attaching means being releasable, whereby said forward leg assembly may be released from said perimeter member;

said aft leg assembly may pivot aft about said second connecting means; and said canopy may be pivoted aft to serve as a sail.

3. On a watercraft to be occupied by an individual, a canopy comprising:

a generally planar rigid frame, a rigid forward leg assembly, a rigid aft leg assembly, a cover, and a plurality of brackets;

said frame including a perimeter member;

said frame being generally horizontally oriented, overhead of said individual;

said forward leg assembly being attached, by attaching means, to a forward portion of said frame and projecting downward from said frame;

said forward leg assembly having at least one forward lower extremity;

each of said at least one forward lower extremity having first connecting means;

a first number of said brackets corresponding to the number of said at least one forward lower extremity being mounted on said watercraft and connected to said first connecting means;

said first connecting means being releasable;

said aft leg assembly being attached, by attaching means, to an aft portion of said frame and projecting downward from said frame;

said aft leg assembly projecting perpendicularly downward from said perimeter member and having at least one aft lower extremity;

each of said at least one aft lower extremity having second connecting means;

wherein the canopy comprises a total quantity of at least three lower extremities including each of the at least one forward lower extremity and the at least one aft lower extremity;

a second number of said brackets corresponding to the number of said at least one aft lower extremity being mounted on said water craft, aft of said first number of brackets and being connected to said second connecting means;

said second connecting means being designed for pivoting about an axis generally perpendicular to the centerline of said watercraft;

said cover being formed of material designed to impede the passage of sunlight and being attached to said frame, for protecting said individual from direct sunlight;

said attaching means being designed for pivoting about an axis generally perpendicular to the centerline of said watercraft;

whereby said forward leg assembly may be released from said watercraft, said frame may pivot aft about said second connecting means, said forward leg assembly may pivot to a position generally parallel to said frame, and said cover may act as a sail.

4. The canopy of claim 3 wherein:

said attaching means being releasable, whereby said forward leg assembly may be released from said perimeter member;

said aft leg assembly may pivot aft about said second connecting means; and said canopy may be pivoted aft to serve as a sail.

5. On a watercraft to be occupied by an individual, a canopy comprising:

a generally planar rigid frame, a rigid forward leg assembly, a rigid aft leg assembly, a cover, and a plurality of brackets;

said frame including a perimeter member;

said frame being generally horizontally oriented, overhead of said individual when placed in a shade configuration;

said forward leg assembly being attached, by attaching means, to a forward portion of said frame and projecting downward from said frame;

said forward leg assembly having at least one forward lower extremity;

each of said at least one forward lower extremity having first connecting means;

said forward leg assembly being removably attached from at least one of said frame and said first connecting means;

a first number of said brackets corresponding to the number of said at least one forward lower extremity being mounted on said watercraft and connected to said first connecting means;

said aft leg assembly being attached, by attaching means, to an aft portion of said frame and projecting downward from said frame;

said aft leg assembly projecting perpendicularly downward from said perimeter member and having at least one aft lower extremity;

each of said at least one aft lower extremity having second connecting means;

said second connecting means being designed for pivoting about an axis generally perpendicular to the centerline of said watercraft;

said canopy being pivotally positioned via said second connecting means into a substantially vertical orientation in a sail configuration;

a second number of said brackets corresponding to the number of said at least one aft lower extremity being mounted on said water craft, aft of said first number of brackets and being connected to said second connecting means;

said cover being formed of material designed to impede the passage sunlight and being attached to said frame, for protecting said individual from direct sunlight; and said cover being formed of material designed to impede the passage of wind and said cover may act as a sail.

6. The canopy of claim 5, wherein;

said frame is of generally elongate rectangular shape defined by said perimeter member; and whereby the head, torso, and outstretched legs of said individual are protected from direct sunlight.

7. The canopy of claim 5, wherein;

said all leg assembly is rigidly affixed to said frame at a predisposed angle.

8. The canopy of claim 7, wherein;

a joint used to rigidly affix said aft leg assembly to said frame is reinforced.

9. The canopy of claim 5, wherein;

said at least one aft lower extremity is removably coupled to said second number of said brackets.

10. The canopy of claim 5, wherein;

said forward leg assembly is pivotally affixed to said frame.

* * * * *